US006642186B2

(12) United States Patent
Beatty et al.

(10) Patent No.: US 6,642,186 B2
(45) Date of Patent: Nov. 4, 2003

(54) ADDITIVE FOR LUBRICANTS

(75) Inventors: Richard Paul Beatty, Wilmington, DE (US); Peter Arnold Morken, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/041,808

(22) Filed: Oct. 19, 2001

(65) Prior Publication Data

US 2002/0103090 A1 Aug. 1, 2002

Related U.S. Application Data

(63) Continuation-in-part of application No. 09/408,829, filed on Sep. 29, 1999, now abandoned.
(60) Provisional application No. 60/102,845, filed on Oct. 2, 1998.

(51) Int. Cl.[7] ..... C10M 105/50; C10M 107/00
(52) U.S. Cl. ..... 508/154; 508/215; 508/438; 508/504; 508/505; 508/545; 508/551; 508/579; 508/588

(58) Field of Search ..... 508/545, 551, 508/579, 181, 419, 452, 588, 154, 215, 438, 504, 505

(56) References Cited

U.S. PATENT DOCUMENTS

| | | | |
|---|---|---|---|
| 2,433,844 | A | 1/1948 | Hanford |
| 2,562,547 | A | 7/1951 | Hanford et al. |
| 2,715,107 | A | 8/1955 | Talley et al. |
| 3,124,533 | A | 3/1964 | Metro et al. |
| 3,284,355 | A | 11/1966 | Papayannopoulos |
| 4,185,031 | A | 1/1980 | Gillman et al. |
| 5,032,306 | A | 7/1991 | Cripps |
| 5,391,814 | A | 2/1995 | Kai et al. |

FOREIGN PATENT DOCUMENTS

| | | |
|---|---|---|
| EP | 0116417 A2 | 8/1984 |
| GB | 1076543 | 7/1967 |
| GB | 2245587 A | 1/1992 |
| JP | 2604186 | 4/1997 |

*Primary Examiner*—Margaret Medley

(57) ABSTRACT

Organic compounds containing selected functional groups, and which are grafted with fluorinated olefins, are excellent additives for lubricants which lower wear and/or friction. They are especially useful in metal lubricants.

17 Claims, No Drawings

ADDITIVE FOR LUBRICANTS

This application is a continuation-in-part of Ser. No: 09/408,829 filed on Sep. 29, 1999 now abandoned which claims the benefit of Provisional application Ser. No. 60/102,845, filed Oct. 2, 1998.

FIELD OF THE INVENTION

Organic compounds which are grafted with fluorinated olefins and contain groups which are adsorbed on metal surfaces are excellent additives to lubricants for reducing wear and/or friction between moving parts.

TECHNICAL BACKGROUND

Lubricants of various sorts are widely used in systems containing moving parts which rub against one another, and are primarily used to reduce wear between the parts and/or reduce friction between the parts, usually both. Secondarily they may perform other functions, such as protecting metal parts from corrosion. While a "base" material is usually used for the majority of a lubricant composition, various additives are usually also used in the composition, such as additives to reduce wear, reduce friction, prolong the life of the lubricant, make the lubricant useful over a wider temperature range, and for many other purposes. Therefore, improved (in price and/or lubricant properties) additives are constantly being sought.

The use of various fluorinated organic compounds in lubricant systems is known in the art, see for instance U.S. Pat. Nos. 2,433,844, 5,391,814 and Japanese Patent 2,604, 186. However, many of these compounds have the disadvantage of being pure compounds (or defined mixtures thereof) which are expensive to synthesize, and therefore expensive to use. It would be preferable to use compounds which are relatively simple and therefore cheap to make, and to use these in relatively small quantities in lubricant systems, to keep cost down.

U.S. Pat. No. 2,562,547 describes the grafting of a variety of organic compounds with certain fluoroolefins such as tetrafluoroethylene (TFE), and uses for the various fluorinated products. The use of certain of these types of compounds as unexpectedly superior lubricant additives is not described.

U.S. Pat. No 5,032,306 describes the use of hydrocarbons grafted with perfluoroolefins as lubricants in certain refrigeration systems. No mention is made of grafting compounds which contain functional groups.

SUMMARY OF THE INVENTION

This invention concerns a composition comprising:

(a) a major portion of a lubricant base; and (b) a minor portion of a first lubricant additive which is an organic compound which is grafted with one or more fluorinated olefins and which, when combined with a lubricant base, forms a lubricant;

and provided that:

said additive contains at least 5 percent by weight of fluorine; and said organic compound contains at least one functional group which can be adsorbed on a metal surface and wherein said functional group is selected from the group consisting of carboxylic esters, carboxylic acids, carboxylic amides, imides, amines, phosphoric acid derivatives, phosphonic acid derivatives, dithiophosphate esters, ethers, hydroxyls, carbonates, thio derivatives thereof, and heterocyclic groups.

The invention also concerns an apparatus, comprising:

(a) a first part which is metal;

(b) a second part which is in apparent contact with said first metal part, and said first part and second part move with respect to one another; and (c) a lubricant which comprises:

(i) a major portion of a lubricant base; and (ii) a minor portion of a first lubricant additive which is an organic compound which is grafted with one or more fluorinated olefins and which, when combined with a lubricant base, forms a lubricant;

and provided that:

said additive contains at least 5 percent by weight of fluorine; and said organic compound contains at least one functional group which can be adsorbed on a metal surface and wherein said functional group is selected from the group consisting of carboxylic esters, carboxylic acids, carboxylic amides, imides, amines, phosphoric acid derivatives, phosphonic acid derivatives, dithiophosphate esters, ethers, hydroxyls, carbonates, thio derivatives thereof, and heterocyclic groups.

DETAILS OF THE INVENTION

Herein certain terms are used, some of them relating to lubricants. Lubricant technology is well known in general, see for instance E. R. Booser, Ed., *CRC Handbook of Lubrication,* Vol. II, CRC Press, Inc., Boca Raton, Fla., U.S.A., (1983), p. 229–315; D. Klamann in B. Elvers, et al., Ed., *Ullmann's Encyclopedia of Industrial Chemistry,* Vol. A15, VCH Verlagsgesellschaft mbH, Weinheim, Germany (1990), p. 424–511; R. M. Mortimer, et al., Ed., *Chemistry and Technology of Lubricants,* VCH Publishers, New York, 1992; all of which are hereby included by reference. Herein the following terms are defined as:

A lubricant base is a material that is the majority of the component of the lubricant system, and which reduces friction and/or wear between the moving components being lubricated, and may also have other useful functions. Useful lubricant bases include petroleum derived (sometimes also called mineral) lubricants, synthetic hydrocarbons, polyether oils, carboxylic esters, phosphoric acid esters, silicone containing oils, and halogenated hydrocarbons and halocarbons. Petroleum derived and synthetic hydrocarbon lubricant bases are preferred and petroleum derived lubricant bases are especially preferred.

A lubricant additive is a chemical which improves the wear-reducing ability or decreases the friction of a lubricant base when a state of hydrodynamic lubrication cannot be maintained. Common lubricants provide for a liquid film between parts moving with respect to one another. This is called hydrodynamic lubrication. As long as a full hydrodynamic liquid film is maintained between the parts, wear will be minimized and friction will be determined entirely by the properties of the fluid film. Hydrodynamic lubrication is often difficult to achieve and maintain in practice. Many lubricants, such as mineral oils, found to be highly effective under hydrodynamic lubricating conditions exhibit seriously degraded performance when conditions depart therefrom. It is for this reason that lubricant additives are necessary. Addition of lubricant additives to lubricant bases results in lubricant compositions which exhibit excellent lubricating performance over a wide range conditions in use. The present invention is directed to a particular class of compositions, hereinbelow described, which have surprisingly been found to be highly effective as lubricant additives.

By an organic compound is meant a compound which contains at least one hydrogen atom bound directly to a carbon atom.

By a functional group is meant any group or moiety containing an element other than carbon, hydrogen and fluorine. These are sometimes called "polar head groups". See for instance J. A. Crawford, et al., in R. M. Mortimer, et al., Ed., *Chemistry and Technology of Lubricants,* VCH Publishers, New York, 1992, p. 165, and A. J. Groszek, *Interdisciplinary Approach to Lubricant Technology*, NASA SP-318 1973, p. 477–525, both of which are hereby included by reference.

By adsorbed on the metal surface is meant that the functional group concerned (and hence the compound which contains that functional group) is attracted to a metal surface with energies in excess of ordinary Van der Waals forces, as exhibited by hydrocarbons such as n-alkanes. The molecule which contains the functional group is often a so-called amphiphile, which has the functional group, and another part of the molecule is compatible with the lubricant base being used. The use of these amphiphiles as lubricant additives and associated topics are also discussed in M. Salmeron, Chemtech, September 1998, p. 17; H. A. Spikes, Langmuir, vol. 12, p. 4567 (1996); M. K. Chaudry, Current Opinion Colloid Interfacial Sci., vol. 2, p. 65 (1997), all of which are hereby included by reference. This adsorption may be measured by adsorbing the compound containing the functional group on the metal surface from a solution in n-alkane, as described in A. J. Groszek, *Interdisciplinary Approach to Lubricant Technology*, NASA SP-318 1973, p. 477–525. Such forces can include covalent or coordinative bonding, electrostatic or coulombic interactions, and hydrogen bonding. This metal surface herein includes not only the metals themselves, but any other layer normally present on the surface of a particular metal, such as an oxidation layer. For example, aluminum typically has a layer of aluminum oxide (which may be partially hydrated) on its surface.

By a fluorinated olefin is meant any olefin containing at least one fluorine atom. Such an olefin may contain one or more ether groups, and includes vinyl ethers.

By grafting herein is meant that one or more molecules of the fluorinated olefin is covalently bonded to the organic compound by a free radical, anionic or other process, and preferably a free radical process.

By "apparent contact" is meant that the surfaces appear to contact each other, but may in fact be separated slightly, as by a film of lubricant or an adsorbed film of additive.

The organic compound which is suitable for use as a lubricant additive according to the present invention has at least one functional group which can "preferentially" adsorb onto a metal surface, preferably a metal which is actually being used in an apparatus being lubricated. Useful functional groups include carboxylic esters, carboxylic acids, carboxylate salts, carboxylic amide, imide, amine, phosphoric or phosphonic acid derivatives such as esters, dithiophosphate ester, ether, hydroxyl, carbonate, hetereocyclic groups (such as N, S and/or O compounds), sulfonic acids that their salts, and analogous sulfur compounds such as thioamides and thioesters. Such functional groups are known in the art, see for instance R. M. Mortier, et al., *Chemistry and Technology of Lubricants,* VCH Publishers, New York, 1992, p. 165; and A. J. Groszek, *Interdisciplinary Approach to Lubricant Technology*, NASA SP-318 1973, p. 477–525, which are hereby included by reference. Preferred functional groups are carboxylic ester, carboxylic acid, hydroxyl, and carboxylic amide, and carboxylic ester, and carboxylic acid are more preferred, and carboxylic ester, is especially preferred. There may be more than one functional group in the organic compound and if more than one, they may be the same or different. Dicarboxylic esters are also especially preferred.

In one preferred form the organic compound (before grafting) has a boiling point at atmospheric pressure of greater than about 150° C., more preferably greater than about 200° C., and especially preferably greater than 250° C. In another preferred form the additive (organic compound after grafting) has a boiling point at atmospheric pressure of greater than about 150° C., more preferably greater than about 200° C., and especially preferably greater than 250° C. In another preferred form the organic compound has a molecular weight of about 100 to about 3,000, more preferably about 250 to 1,500. Grafted polymers, especially those of lower molecular weight, may also be used.

Any fluorinated olefin that may be free radically grafted onto the chosen organic compound may be used. Such fluorinated olefins are known in the art, see for instance U.S. Pat. Nos. 2,562,547 and 5,032,306 both of which are hereby included by reference. The grafting may also be initiated by thermally, photochemically and by irradiation, see B. Ameduri, et al., in *Topics in Current Chemistry*, Vol. 192. *Organofluorine Chemistry, Fluorinated Alkenes and Reactive Intermediates*, Springer-Verlag, Berlin, 1997, p. 165–233, which is hereby included by reference. In one preferred form the fluorinated olefin is perfluorinated. In another preferred form it has the formula $R^1R^2C{=}CR^3R^4$ wherein $R^1$ is chlorine, fluorine or hydrogen, $R^2$ and $R^4$ are each independently fluorine or hydrogen, $R^3$ is fluorine, hydrogen, alkyl or fluorinated alkyl, provided that at least one of $R^1$, $R^2$ and $R^4$ are fluorine or $R^3$ is fluorinated alkyl. It is more preferred that $R^1$, $R^2$ and $R^3$ are fluorine, and $R^4$ is fluorine or perfluoro-n-alkyl containing 1 to 10 carbon atoms. In another preferred form, the fluorinated olefin has the formula $F_2C{=}CFOR^5$ wherein $R^5$ is fluorinated alkyl, more preferably perfluoro-n-alkyl containing 1 to 4 carbon atoms. Useful fluorinated olefins include vinyl fluoride, vinylidene fluoride, trifluoroethylene, tetrafluoroethylene, chlorotrifluoroethylene, hexafluoropropylene (HFP), 3,3,4,4,5,5,6,6,6-nonofluoro-1-hexene (PFBE), perfluoro(methyl vinyl ether) (PMVE), perfluoro(n-propyl vinyl ether) (PPVE), 3,3,3-trifluoropropene,1,1,3,3,3-pentafluoropropene, and 1,2,3,3,3-pentafluoropropene. Preferred fluorinated olefins are TFE, chlorotrifluoroethylene, HFP, PFBE, PMVE, vinylidene fluoride, trifluoroethylene, and PPVE, and more preferred fluorinated olefins are TFE, HFP and PMVE, and TFE is especially preferred.

The grafting reaction is initiated by typical free radical generators such as organic peroxides. Such processes are known in the art, see for instance U.S. Pat. Nos. 2,562,547 and 5,032,306. The procedures described in these references and in the appropriate examples herein illustrate how to carry out these grafting reactions. These grafting reactions usually graft the fluorinated olefin in a random manner, although some positions in the organic compound being grafted may be more favored than others. Some of the organic molecules may be ungrafted, especially if no separation is done on the crude mixture obtained after grafting.

Such a separation may be difficult and expensive due to the high boiling point of many of the useful organic compounds. The total amount of fluorine in the grafted compound is based on the weight of the total grafted compound including ungrafted organic molecules when they are present. The fluorinated groups grafted onto the organic compound may contain one or more molecules of fluorinated olefin, depending on the fluorinated olefin used, the organic compound used, the free radical source used, and the grafting conditions. The total amount of fluorine in the grafted organic compound will also be affected by these variables. The grafted organic compound suitable for use as a lubricant additive according to the present invention should contain at least about 5 weight percent fluorine, preferably at least about 8 weight percent fluorine, and more preferably at least about 15 weight percent fluorine (elemental analysis). Preferably the grafted organic compound should be a liquid.

The grafted olefin compound suitable for use as a lubricant additive according to the present invention is combined with a lubricant base to form a lubricant. The major portion of this composition by weight, based on the total amount of lubricant base and grafted olefin compound present, is the lubricant base, and the minor portion is the grafted olefin compound. Preferably the amount of grafted olefin compound is such that the amount of fluorine in the lubricant (base lubricant plus grafted olefin compound) from the grafted olefin compound is about 200 ppm to about 10 percent by weight, more preferably about 500 ppm to about 3 percent by weight, and especially preferably about 0.10 to about 1.0 percent by weight. Preferably also the base lubricant and grafted olefin polymer form a single liquid phase at the lubricant use temperature, and/or the entire lubricant composition forms a single liquid phase at the lubricant use temperature.

Preferably the grafted olefin compound and base lubricant should not react with one another to form deleterious products (of course at high operating temperatures lubricants may degrade but this is not included in this statement). A particular functional group may react with a particular lubricant base, but usually a suitable combination of either a particular grafted organic compound or particular lubricant base with a counterpart can be found with minimal experimentation. Such a reaction at times may be benign or even beneficial.

The lubricant composition of the invention, comprising a lubricant base and a lubricant additive may include other additives that are conventionally added to lubricants for various purposes. These include oxidation inhibitors (including antioxidants and metal oxidation inhibitors), viscosity index improvers, pour point depressants, detergents and dispersants, extreme pressure additives, demulsifiers, corrosion inhibitors, emulsifiers and emulsifying aids, dyes and deblooming agents, fluorescent additives, antifoam agents, and (other) antiwear and friction modifiers. The entire lubricant may be a solid, semisolid (grease) or liquid at room temperature, but is preferably a liquid at the operating temperature of the thing being lubricated.

Lubricants are generally employed where two parts are in contact and move with respect to one another. For the lubricants containing the grafted organic compound it is preferred that at least one of the parts, and preferably both of the these parts are metallic. It is also preferred that for the particular metal present the functional group of the additive adsorbs to that metal. The choice of (a) functional group(s) is often not critical in this respect, although a particular functional group may be better with some metals than others.

If a nonmetallic part is part of this apparatus, it may be a ceramic, a thermoplastic, or a thermoset. Any combination ("composite") of metals and any of the nonmetallic materials may also be used. If nonmetals are used, they may bear functional groups which can interact with the functional group of the additive. Metals useful for the moving part(s) include ferrous metals such as steel, stainless steel and cast iron, aluminum, and zinc and zinc alloys such as die cast metals, titanium, vanadium, chromium, molybdenum, nickel, lead, tin, copper, and their alloys, such as bronze and brass. Preferred metals are ferrous metals. The metal of the two parts may be the same or different. Of course more than two moving parts may be present in such an apparatus.

The lubricant may be distributed to the places where it is needed by conventional means, such as a lubricant (oil) pump, or just be present where needed.

In the Examples, the following abbreviations are used:

HFP—hexafluoropropylene

PFBE—3,3,4,4,5,5,6,6,6-nonafluoro-1-hexene

PMVE—perfluoro(methyl vinyl ether)

TFE—tetrafluoroethylene

VF2—vinylidene fluoride

Test Methods

Samples were tested using the ball-on-cylinder (BOCLE) test, described in ASTM D5001, as modified. Several modifications were made to the test, as summarized in Table 1. These changes are expected to make the test a more severe test of anti-wear and friction modifying properties, as described below.

TABLE 1

Ball-on-cylinder test conditions

| Standard ASTM D5001 | Modified D5001 (consequence) |
|---|---|
| 0.5" (1.27 cm) ball | 0.25" (0.64 cm) ball (smaller contact area) |
| 25° C. | 80° C. (lower lubricant viscosity) |
| 1000 g load, 30 minutes | 500 g break in load, 0.5 minute, followed by 6000 g test load, 30 minutes (higher contact pressure; note that a 6000 g load produces a 12,000 g normal force at the ball-cylinder contact point) |
| No friction data | Calibrated load cell to measure tangential force on ball during test (allows calculation of coefficient of friction from ratio of tangential force to normal force, 12,000 g) |

TABLE 2

Solvent refined 150N oil BOCLE results

| Solvent-refined 150N oil | Coefficient of friction | Wear scar, mm |
|---|---|---|
| Number of measurements | 9 | 13 |
| Average | 0.1424 | 0.851 |
| Standard deviation | 0.0052 | 0.042 |
| 95% Confidence interval | ±0.00399 | ±0.025 |

The relative performance of the materials of the present invention as additives in a mineral oil base fluid was evaluated. A commonly available high-quality solvent-refined 150 neutral oil (150N), about ISO 32 viscosity grade, was used. A grade of oil such as 150N might be used as one component for blending of an oil for use in an internal combustion engine. The 150 N contains no additives. This 150N oil was tested according to the modified BOCLE method numerous times, and the average of these results is summarized in Table 2.

For comparative purposes, the friction and wear performance of several fully formulated (ILSAC GF-1), commercially available passenger car motor oils were measured. The oils tested included two leading full synthetics (MOBIL® 15W30, Castrol® SYNTEC® 5W50) and one conventional non-synthetic oil (MOTORCRAFT® 5W30). Performance of all three oils was very similar, as summarized in Table 3. This may be because all three contain similar amounts of zinc dialkyldithiophosphate (ZDDP), an extremely effective anti-wear agent.

TABLE 3

Commercially Available GF-1 Motor Oil BOCLE Test Results

| Formulated GF-1 Motor oils | Coefficient of friction | Wear scar, mm |
|---|---|---|
| Number of measurements | 2 | 9 |
| Average | 0.1313 | 0.499 |
| Standard deviation | 0.0029 | 0.029 |
| 95% Confidence interval | ±0.0260 | ±0.022 |

COMPARATIVE EXAMPLE A

Reaction of TFE with Dodecane

A 1 L stirred autoclave was charged with 175 g dodecane (1.03 mole) and 6 g t-butyl peroxide (0.041 mol). The vessel was closed and pressurized to 3.45 MPa with nitrogen and vented. The vessel was then charged to 410 kPa with TFE and vented 3 times. The vessel was stirred at 500 rpm and heated to 140° C. and TFE was added at a rate to maintain pressure between 676–1413 kPa. A total of 214 g (2.14 mol) TFE was added over a 3.5 h period. The vessel was heated an additional 3 hours at 140° C. The crude material was distilled at reduced pressure to remove light side-products as well as unreacted dodecane. Then 1 fraction was collected, "F2" boiling at 88° C./0.01 Pa (44.58 g). The pot material was then distilled by the Kugelrohr method, collecting 102.2 g of oil "K1" boiling at 109° C./0.01 Pa, and 52 g of oil "K2" boiling at 140° C./0.01 Pa. Elemental analysis, $^{1}$H NMR, $^{19}$F NMR, and FTIR indicate that the product has —$(CF_2CF_2)_n$H chains attached to the dodecane backbone. Elemental analysis of F2: 50.24% C, 6.44% H, 43.14% F; K1: 42.72% C, 4.95% H, 52.41% F; K2: 39.95% C, 4.15% H, 55.22% F. $^{1}$H NMR ($CDCl_3$, 400 MHz) of the samples exhibits overlapping triplets (J ca. 50 Hz, $CF_2H$) at 5.5–6.1 ppm and overlapping signals at 0.8–2.5 ppm in ratios of 7.7:92.3 for F2, 11.9:88.1 for K1, and 13.8:86.2 for K2.

COMPARATIVE EXAMPLE B

Reaction of TFE with Hydrotreated Heavy Paraffinic Oil

A stainless steel, 1-L stirred vertical autoclave in a barricade was charged with 400 mL of hydrotreated heavy paraffinic oil [ISO 32, Pure Performance(TM) from Conoco, Inc., Houston, Tex.] and 15 g (0.10 mol) of t-butyl peroxide. The vessel was closed and pressurized to 3.45 MPa with nitrogen and vented. The vessel was then charged to 410 kPa with TFE and vented three times. The vessel was stirred at 500 rpm and heated to 140° C. and TFE was added at a rate to maintain the pressure between 751–1540 kPa. A total of 154 g (1.54 mol) TFE was added over a 3.5 h period. After heating for an additional 12 h at 140° C., the volatile components of this mixture were removed by vacuum distillation (180° C./27 Pa/2 h) to leave 404 g of stripped crude product. Distillation of a 56 g sample by the Kugelrohr method gave "K1", 9 g, bp 167° C./0.01 Pa; "K2", 25 g, bp 209° C./0.01 Pa; "K3", 15.5 g, bp 271° C./0.01 Pa and a 5 g pot residue. Elemental analysis of stripped crude 67.59% C, 9.97% H, 22.01% F; K1 71.38% C, 10.80% H, 17.90% F; K2 70.70% C, 10.76% H, 18.74% F; K3 67.30% C, 10.12% H, 22.20% F.

EXAMPLE 1

Reaction of TFE with Tridecyl Alcohol

A stainless steel, 1-L stirred vertical autoclave in a barricade was charged with 250 g of Exxal 13 (tridecyl alcohol mixture of isomers, product of Exxon Chemical Co., Houston, Tex.) and 20 g (0.14 mol) of t-butyl peroxide. The vessel was closed and pressurized to 3.45 MPa with nitrogen and vented. The vessel was then charged to 414 kPa with TFE and vented three times. The vessel was stirred at 500 rpm and heated to 140° C. and TFE was added at a rate to maintain the pressure between 772–1520 kPa. A total of 162 g (1.62 mol) TFE was added over a 3.5 h period. After heating for an additional 12 h at 140° C., the crude product was heated at 195° C. for 2 h, and then the mixture was distilled to give "D3", 44.6 g, bp 128–150° C./133 Pa. The pot residue (89 g) was then distilled by the Kugelrohr method, collecting "K1", 30.3 g, bp 190° C./13 Pa. Elemental analysis of D3 51.73% C, 6.94% H, 36.89% F; K1 51.83% C, 6.74% H, 38.84% F. $^{19}$F NMR ($CDCl_3$) of D3 and K1 show signals from −106 to −138 ppm. $^{1}$H NMR ($CDCl_3$) of K1 5.5–6.2 ppm (m, 4.6% H), 3.1–4.5 (m, 2.4% H), 0.8–3.0 (m, 93% H); K1 FTIR (neat KBr) 3416 $cm^{-1}$ (br, OH), 2962 (m), 1467 (w), 1174 (s), 1111 (vs).

EXAMPLE 2

Reaction of TFE with Octanoic Acid

A stainless steel, 1-L stirred vertical autoclave in a barricade was charged with 250 g (1.73 mol) of octanoic acid and 20 g (0.14 mol) of t-butyl peroxide. The vessel was closed and pressurized to 3.45 MPa with nitrogen and vented. The vessel was then charged to 410 kPa with TFE and vented three times. The vessel was stirred at 500 rpm and heated to 140° C. and TFE was added at a rate to maintain the pressure between 751–1510 kPa. A total of 292 g (2.92 mol) TFE was added over a 3.5 h period. After heating for an additional 12 h at 140° C., the crude product was distilled to give "D3", 83.3 g, bp 135–175° C./50 Pa. The pot residue was then distilled by the Kugelrohr method, collecting "K1", 35.2 g, bp 240° C./8 Pa. Elemental analysis of D3 38.58% C, 3.82% H, 48.04% F; K1 40.50% C, 3.92% H, 51.76% F. $^{19}$F NMR ($CDCl_3$) of D3 and K1 show signals from −106 to −138 ppm. $^{1}$H NMR ($CDCl_3$) of D3 11.8 ppm (br, COOH, 1H), 5.5–6.2 (m, 2.1 H), 0.8–3.5 (m, 14.2 H); K1 11.8 ppm (br, COOH, 1H), 5.5–6.2 (m, 2.2 H), 0.8–3.5 (m, 21.6 H); FTIR of D3 (neat/KBr) 2500–3500 $cm^{-1}$ (br), 1721 (s), 1173 (s), 1111 (vs); K1 2500–3500 $cm^{-1}$ (br), 1720 (s), 1173 (s), 1113 (vs).

EXAMPLE 3

Reaction of TFE with Dimethyl Adipate

A stainless steel, 1-L stirred vertical autoclave in a barricade was charged with 250 g (1.44 mol) of dimethyl adipate and 20 g (0.14 mol) of t-butyl peroxide. The vessel was closed and pressurized to 3.45 MPa with nitrogen and vented. The vessel was then charged to 410 kPa with TFE and vented three times. The vessel was stirred at 500 rpm and heated to 140° C. and TFE was added at a rate to maintain the pressure between 786–1500 kPa. A total of 414 g (4.14 mol) TFE was added over a 5 h period. After heating for an additional 12 h at 140° C., the crude product was distilled by the Kugelrohr method to give 73.4 g of white solid, bp 180° C./0.01 Pa. Elemental analysis 34.12% C, 2.77% H, 48.67% F; $^1$H NMR (2:1 $C_6F_6$:$C_6D_6$). $^1$H NMR 5.5–6.2 ppm (m, 8.6 H), 4.4–4.7 (m, 1.0 H), 0.9–4.0 (m, 85.7 H); FTIR 2961 cm$^{-1}$ (w), 1746 (s), 1440 (w), 1209 (vs).

EXAMPLE 4

Reaction of TFE with Dibutyl Adipate

A stainless steel, 1-L stirred vertical autoclave in a barricade was charged with 250 g (0.97 mol) of dibutyl adipate and 20 g (0.14 mol) of t-butyl peroxide. The vessel was closed and pressurized to 3.45 MPa with nitrogen and vented. The vessel was then charged to 410 kPa with TFE and vented three times. The vessel was stirred at 500 rpm and heated to 140° C. and TFE was added at a rate to maintain the pressure between 724–1470 kPa. A total of 480 g (4.8 mol) TFE was added over a 5 h period. After heating for an additional 12 h at 140° C., the crude product was distilled to give "D1", 217 g, bp 170° C./53 mPa. The remaining material was then distilled by the Kugelrohr method, collecting "K1", 123 g, bp 195° C./0.01 Pa and leaving 127 g of pot residue. Elemental analysis of D1 44.34% C, 5.11% H, 39.85% F; K1 37.81% C, 3.36% H, 44.90% F; pot residue 36.27% C, 3.26% H, 50.81% F. $^1$H NMR ($CDCl_3$) of D1 5.5–6.2 ppm (m, 7.6 H), 4.0–4.5 (m, 13 H), 2.6–3.3 (m, 2.7 H), 0.8–2.5 (m, 77 H); $^1$H NMR ($CDCl_3$) of K1 5.5–6.2 ppm (m, 10 H), 4.0–4.5 (m, 13 H), 2.6–3.3 (m, 3.6 H), 0.8–2.5 (m, 73 H); $^1$H NMR ($C_6D_6$/$C_6F_6$) of pot residue 5.5–6.2 ppm (m, 10 H), 4.0–4.5 (m, 12 H), 0.8–3.6 (m, 77 H); $^{19}$F NMR of the samples show overlapping signals from −105 to −140 ppm. Typical FTIR (K1)2968 cm$^{-1}$ (m), 1741 (s), 1173 (vs).

A 52.5 g sample of K1 was centrifuged on a Sorvall Instruments RC-5C Centrifuge using a SS-34, 8 place, 50 mL, aluminum, fixed angle (34 deg.) rotor at 20,000 rpm. Clear supernatant (44.4 g) and 1.18 g solid were recovered, and the remaining 6.92 g was lost in transfer. Elemental analysis of the supernatant was 38.03% C, 3.58% H, 46.14% F.

EXAMPLE 5

Reaction of TFE with Diisooctyl Azelate

A 1-L stirred vertical autoclave was charged with 250 g (0.61 mol) of diisooctyl azelate and 20 g (0.14 mol) of t-butyl peroxide. The vessel was closed and pressurized to 3.45 MPa with nitrogen and vented. The vessel was then charged to 410 kPa with TFE and vented three times. The vessel was stirred at 500 rpm and heated to 140° C. and TFE was added at a rate to maintain the pressure between 717–1550 kPa. A total of 148 g (1.48 mol) TFE was added over a 4 h period. After a 12 h hold period at 140° C., the vessel was cooled and the volatile components of the mixture were removed by vacuum distillation (195° C./40 Pa/2 h) to leave 377 g cloudy liquid. Elemental analysis was 56.28% C, 7.34% H, 25.95% F. $^{19}$F NMR overlapping signals from −105 to −140 ppm. $^1$H NMR ($CDCl_3$) 5.5–6.2 (m, 3.2 H), 3.9–4.4 (m 7.4 H), 0.7–2.9 (m, 89 H). FTIR 2960 cm$^{-1}$ (m), 1736 (s), 1466 (m), 1109 (vs).

EXAMPLE 6

Reaction of TFE with Jayflex-DIDA

A stainless steel, 1-L stirred vertical autoclave in a barricade was charged with 300 mL (273 g) of Jayflex-DIDA (diisodecyl adipate, product of Exxon Chemical Americas, Houston, Tex.) and 7 g (0.05 mol) of t-butyl peroxide. The vessel was closed and pressurized to 3.45 MPa with nitrogen and vented. The vessel was then charged to 410 kPa with TFE and vented three times. The vessel was stirred at 500 rpm and heated to 140° C. and TFE was added at a rate to maintain the pressure between 1.03–1.42 MPa. A total of 78 g (0.78 mol) TFE was added over a 4.5 h period. The vessel was cooled, then charged with an additional 10 g (0.07 mol) of t-butyl peroxide, pressure-vented as described before, then fed an additional 92 g (0.92 mol) of TFE at 140° C. over a 3.5 h period, then held at 140° C. for 4 h. The vessel was cooled and 385 g of milky white material were collected. The analytical data were consistent with a plurality of —$CF_2CF_2H$ and —$(CF_2CF_2)_nH$ groups per diester. Elemental analysis (duplicate) was 56.90–56.71% C, 8.06–7.98% H, 23.92–24.15% F. $^1$H NMR showed 2.4% of the intensity in the 5.5–6.5 ppm region, assigned to the —$CF_2H$ group. $^{19}$F NMR overlapping signals from −106 to −139 ppm; FTIR 2961 cm$^{-1}$ (s), 1738 (vs), 1175 (s). Charged 331 g of crude material to 500 mL flask fitted with distillation takeoff and dry-ice cooled receiver. Reduced pressure to <130 Pa, then heated crude from ambient temperature to 197° C. over 80 min. Maximum head temperature was 147° C. Held at 197° C. pot temperature/40 Pa pressure for 15 min to ensure decomposition and removal of residual peroxide and decomposition products. Recovered 35 g distillate. Elemental analysis of product: 25.76% F.

EXAMPLE 7

Reaction of TFE with Jayflex-DIDA

A 1-L stirred vertical autoclave was charged with 275 g of Jayflex-DIDA and 20 g (0.14 mol) of t-butyl peroxide. The vessel was closed and pressurized to 3.45 MPa with nitrogen and vented. The vessel was then charged to 410 kPa with TFE and vented three times. The vessel was stirred at 500 rpm and heated to 140° C. and TFE was added at a rate to maintain the pressure between 689–1590 kPa. A total of 170 g (1.7 mol) TFE was added over a 4.5 h period. After a 12 h hold period at 140° C., the vessel was cooled and the contents were collected. The vessel was rinsed with acetone, the acetone wash was concentrated by rotary evaporation, and the residue was combined with the bulk crude to afford 402.2 g of milky-white liquid. The volatile components of this mixture were removed by vacuum distillation (190° C./67 Pa/1.5 h) to leave 368.7 g milky-white liquid residue, density 1.12 g/mL. Elemental analysis was 58.77% C, 8.27% H, 29.51% F.

EXAMPLE 8

Reaction of TFE with Jayflex-DIDA

A 1-L stirred vertical autoclave was charged with 500 g of Jayflex-DIDA and 4 g (0.03 mol) of t-butyl peroxide. The vessel was closed and pressurized to 3.45 MPa with nitrogen and vented. The vessel was then charged to 410 kPa with TFE and vented three times. The vessel was stirred at 500 rpm and heated to 140° C. and 30 g (0.3 mol) TFE was added over a 0.1 h period. The maximum pressure observed was 690 kPa. After a 12 h hold period at 140° C., the vessel was cooled and 509 g of colorless, slightly hazy crude product were collected. The volatile components of this mixture were removed by vacuum distillation (195° C./67 Pa/2 h) to leave 500 g of liquid. Elemental analysis was 71.08% C, 11.00% H, 7.48% F. $^{19}$F NMR overlapping signals from −105 to −140 ppm.

EXAMPLE 9

Reaction of TFE with Jayflex-DIDA

A 1-L stirred vertical autoclave was charged with 275 g of Jayflex-DIDA and 20 g (0.14 mol) of t-butyl peroxide. The vessel was closed and pressurized to 3.45 MPa with nitrogen and vented. The vessel was then charged to 410 kPa with TFE and vented three times. The vessel was stirred at 500 rpm and heated to 140° C. and TFE was added at a rate to maintain the pressure between 731–1520 MPa. A total of 176 g (1.8 mol) TFE was added over a 4.5 h period. After a 12 h hold period at 140° C., the vessel was cooled and 386 g of cloudy liquid were collected. The volatile components of this mixture were removed by vacuum distillation (195° C./67 Pa/2 h) to leave 336 g crude product. Elemental analysis was 57.69% C, 7.85% H, 20.97% F. $^{19}$F NMR overlapping signals from −105 to −139 ppm.

EXAMPLE 10

Reaction of HFP with Jayflex-DIDA

A 1 L steel shaker tube was charged with 200 g Jayflex-DIDA and 2.5 g (17 mmol) t-butyl peroxide. The vessel was closed, cooled, and evacuated, then 150 g (1 mol) of hexafluoropropene (HFP) were added. The vessel was heated with shaking at 135° C. for 1 h and 140° C. for 6 h. The contents of the vessel were removed and then heated in vacuo for 2 h at 180° C. The clear, homogeneous liquid product had the following composition by elemental analysis (duplicate): 69.26–69.39% C, 10.77–10.98% H, 9.03–8.79% F. $^{19}$F NMR -74.4 (m), −110 −125 (m), −206 −215 (m).

EXAMPLE 11

Reaction of HFP with Jayflex-DIDA

A 1 L steel shaker tube was charged with 200 g Jayflex-DIDA and 5 g (34 mmol) t-butyl peroxide. The vessel was closed, cooled, and evacuated, then 300 g (2 mol) of hexafluoropropene (HFP) were added. The vessel was heated at 135° C. for 1 h and 140° C. for 6 h. The contents of the vessel were removed and then heated in vacuo for 2 h at 180° C. The clear, homogeneous liquid product had the following composition by elemental analysis (duplicate): 67.75–67.79% C, 10.2–10.47% H, 12.53–12.72% F. $^{19}$F NMR −74.4 (m), −110 −125 (m), −206 to −215 (m).

EXAMPLE 12

Reaction of PMVE with Jayflex-DIDA

A 0.36 L steel shaker tube was charged with 80 g Jayflex-DIDA and 7 g (0.05 mol) t-butyl peroxide. The vessel was closed, cooled, and evacuated, then 60 g (0.36 mol) of perfluoromethylvinyl ether (PMVE) were added. The vessel was heated at 140° C. for 5 h. The contents of the vessel were removed and then heated in vacuo for 1.5 h at 140° C. The cloudy liquid product (106 g) had the following composition by elemental analysis: 55.91% C, 7.91% H, 19.62% F.

EXAMPLE 13

Reaction of VF2 with Jayflex-DIDA

A 1-L stirred vertical autoclave was charged with 250 g of Jayflex-DIDA and 25 g (0.17 mol) of t-butyl peroxide. The vessel was closed and pressurized to 3.45 MPa with nitrogen and vented. The vessel was then charged to 410 kPa with 1,1-difluoroethene (VF2) and vented three times. The vessel was stirred at 500 rpm and heated to 140° C. and VF2 was added at a rate to maintain the pressure between 972–1530 kPa. A total of 49 g (0.77 mol) VF2 was added over a 4.5 h period. After a 12 h hold period at 140° C., the vessel was cooled and 302 g of cloudy liquid were collected. The volatile components of this mixture were removed by vacuum distillation (180° C./27 Pa/2 h) to leave 277 g crude product. Elemental analysis was 69.74% C, 10.75% H, 8.92% F. $^{19}$F NMR overlapping signals from −90 to −100 ppm (28% F) and −108 to −116 ppm (72% F).

EXAMPLE 14

Reaction of TFE with Ditridecyl Dodecanedioate

A 0.4 L steel shaker tube was charged with 250 g of ditridecyl dodecanedioate (Hatcol 2907, mixture of C11–C14 alcohols used for ester, product of Hatco Corp., Fords, N.J.) and 2 g (0.014 mol) of t-butyl peroxide. The vessel was closed, cooled, and evacuated, then 10 g (0.10 mol) of TFE were added. The vessel was heated with shaking at 140° C. for 16 h. The contents of the vessel were removed and then heated in vacuo for 2 h at 190° C. to afford 242 g milky white product. Elemental analysis (duplicate): 75.81–75.46% C, 11.92–11.86% H, 3.95–3.87% F. $^{19}$F NMR overlapping signals from −115 to −140 ppm.

EXAMPLE 15

Reaction of TFE with Ditridecyl Dodecanedioate

A 0.4 L steel shaker tube was charged with 100 g of ditridecyl dodecanedioate (Hatcol 2907, mixture of C11–C14 alcohols used for ester, product of Hatco Corp., Fords, N.J.) and 6 g (0.04 mol) of t-butyl peroxide. The vessel was closed, cooled, and evacuated, then 40 g (0.40 mol) of TFE were added. The vessel was heated with shaking at 140° C. for 16 h. The contents of the vessel were removed and then heated in vacuo for 2 h at 180° C. to afford 109 g milky white product. Elemental analysis (duplicate): 62.41–62.34% C, 9.04–9.14% H, 22.53–22.26% F. $^{19}$F NMR overlapping signals from −105 to −140 ppm.

EXAMPLE 16

Reaction of PFBE with Ditridecyl Dodecanedioate

A 0.4 L steel shaker tube was charged with 100 g of ditridecyl dodecanedioate (Hatcol 2907, mixture of C11–C14 alcohols used for ester, product of Hatco Corp., Fords, N.J.), 30 g of perfluorobutylethylene (0.122 mol, PFBE), 100 ml of 1,2-dichlorobenzene (ODCB) and 3 g (0.02 mol) of t-butyl peroxide. The vessel was closed, cooled, and evacuated. The vessel was heated with shaking at 140° C. for 16 h. The contents of the vessel were then heated in vacuo for 2 h at 190° C. to remove ODCB. A milky yellow product (125 g) remained in the pot. Elemental analysis (duplicate): 68.16–68.39% C, 10.38–10.31% H, 17.06–16.87% F. $^{19}$F NMR (acetone-$d_6$) ? −82.4 (bs, 3F), −115.4 (bs, 2F), −125.2 (m, 2F), −127.1 (bs, 2F).

EXAMPLE 17

Reaction of TFE with Trimethylolpropane Mixed Esters

A 1-L stirred vertical autoclave was charged with 250 g of trimethylolpropane mixed esters (Hatcol 2937, mixture of mainly C8 and C10 monocarboxylic acids used for ester, product of Hatco Corp., Fords, N.J.), and 20 g (0.14 mol) of t-butyl peroxide. The vessel was closed and pressurized to 3.45 MPa with nitrogen and vented. The vessel was then charged to 410 kPa with TFE and vented three times. The vessel was stirred at 500 rpm and heated to 140° C. and TFE was added at a rate to maintain the pressure between 662–1560 kPa. A total of 356 g (3.56 mol) TFE was added over a 4.5 h period. After a 12 h hold period at 140° C., the vessel was cooled and 530 g of cloudy liquid were collected. The volatile components of this mixture were removed by vacuum distillation (190° C./13 Pa/2 h) to leave 415 g crude product. Elemental analysis was 46.39% C, 5.41% H, 38.15% F. $^{19}$F NMR overlapping signals from −110 to −138 ppm.

EXAMPLE 18

Reaction of TFE with n-decyl Succinic Anhydride

A 1 L stirred autoclave was charged with 250 g n-decyl succinic anhydride (1.04 mole, Pfaltz and Bauer, Inc.) and 25 g t-butyl peroxide (0.17 mol). The vessel was sealed and pressure vented with nitrogen (3.45 MPa) 1 time and TFE, 410 kPa, 3 times. The vessel was heated to 140° C. and 64 g (0.64 mol) TFE were added over 3 h at a rate to maintain pressure between 910–1410 kPa. The vessel was heated an additional 12 h at 140° C. The crude material was distilled at 25–180° C./13 Pa to remove low-boiling impurities and unreacted n-decyl succinic anhydride. The residue was distilled by the Kugeirohr method, collecting 13.6 g of material boiling at 25–168° C./0.01 Pa, which was contaminated by n-decyl succinic anhydride. The undistilled pot residue weighed 63.7 g. Elemental analysis of the pot residue 59.05% C, 7.49% H, 22.95% F; $^{1}$H NMR ($CDCl_3$, 400 MHz) 5.6–6.4 (m, 1.5H), 0.8–4.0 (m, 98.5 H); FTIR 2929 $cm^{-1}$ (s), 1863 (m), 1784 (vs), 1 108 (s); $^{19}$F NMR ($CDCl_3$, $CFCl_3$ standard) −106 to −138 overlapping signals.

EXAMPLES 19–48 AND COMPARATIVE EXAMPLES C—H

To determine the efficacy of the additives made according to the present invention, their effect on friction and wear was measured as a function of their concentration in the standard 150N oil (see "Test Methods" above). There are two approaches to obtaining a given level of fluorine in a blended lubricant. An additive containing a high level of fluorine can be used at a low treat rate or an additive containing a low level of fluorine can be used at a high treat rate. These two approaches do not necessarily give the same performance.

Results of these tests are given in Table 4. Wear is given as the Wear Scar in mm, while friction is reported as a dimensionless ratio of the (tangential) frictional force to the normal contact force. The grafted organic compound is given in the column headed "Graft of Ex.", and if more than one fraction of the product was made, the fraction used can be determined by the "Wt. % F in Grafted Compound". The total amount of fluorine in the lubricant from the grafted compound is given by the "Wt. % F in Lubricant" column.

TABLE 4

| Ex. | Graft of Ex. | Organic Compound | Fluorinated Olefin | Wt. % F in Grafted Compound | Wt. % F in Lubricant | Wear | Friction |
|---|---|---|---|---|---|---|---|
| 19 | 4 | Dibutyl adipate | TFE | 39.85% | 0.15% | 0.455 | 0.1091 |
| 20 | 4 | Dibutyl adipate | TFE | 39.85% | 0.30% | 0.42 | 0.1175 |
| 21 | 4 | Dibutyl adipate | TFE | 44.90% | 0.15% | 0.535 | 0.1256 |
| 22 | 4 | Dibutyl adipate | TFE | 46.14% | 0.15% | 0.55 | 0.1278 |
| 23 | 4 | Dibutyl adipate | TFE | 46.14% | 0.30% | 0.51 | 0.1179 |
| C | A | Dodecane | TFE | 52.40% | 0.15% | 0.74 | 0.1421 |
| D | A | Dodecane | TFE | 52.40% | 0.30% | 0.775 | 0.1317 |
| 24 | 1 | Tridecyl alcohol | TFE | 36.89% | 0.15% | 0.645 | 0.129 |
| 25 | 1 | Tridecyl alcohol | TFE | 36.89% | 0.30% | 0.58 | 0.1312 |
| 26 | 16 | Diisodecyl dodecandioate | PFBE | 16.97% | 0.15% | 0.76 | 0.1332 |
| 27 | 16 | Diisodecyl dodecandioate | PFBE | 16.97% | 0.30% | 0.74 | 0.1332 |
| 28 | 14 | Diisodecyl dodecandioate | TFE | 3.91% | 0.15% | 0.73 | 0.128 |
| 29 | 14 | Diisodecyi dodecandioate | TFE | 3.91% | 0.30% | 0.705 | 0.129 |
| 30 | 15 | Diisodecyl dodecandioate | TFE | 22.40% | 0.15% | 0.555 | 0.1259 |
| 31 | 15 | Diisodecyl dodecandioate | TFE | 22.40% | 0.30% | 0.505 | 0.1322 |
| 32 | 15 | Diisodecyl dodecandioate | TFE | 22.40% | 0.30% | 0.54 | 0.1332 |
| E | B | Hydroclear ISO 32 | TFE | 18.74% | 0.15% | 0.82 | 0.1421 |
| F | B | Hydroclear ISO 32 | TFE | 18.74% | 0.30% | 0.805 | 0.1358 |
| 33 | 10 | Ditridecyl adipate | HFP | 8.91% | 0.15% | 0.535 | 0.1353 |
| 34 | 10 | Ditridecyl adipate | HFP | 8.91% | 0.30% | 0.56 | 0.1353 |
| 35 | 11 | Ditridecyl adipate | HFP | 12.63% | 0.15% | 0.825 | 0.1311 |
| 36 | 11 | Ditridecyl adipate | HFP | 12.63% | 0.30% | 0.72 | 0.1239 |
| G | — | Ditridecyl adipate | none | 0.00% | 10.00%[a] | 0.82 | 0.1267 |
| H | — | Ditridecyl adipate | none | 0.00% | 20.00%[a] | 0.82 | 0.1356 |
| 37 | 12 | Ditridecyl adipate | PMVE | 19.62% | 0.15% | 0.435 | 0.1345 |
| 38 | 12 | Ditridecyl adipate | PMVE | 19.62% | 0.30% | 0.43 | 0.1356 |
| 39 | 8 | Ditridecyl adipate | TFE | 7.48% | 0.15% | 0.82 | 0.1323 |
| 40 | 8 | Ditridecyl adipate | TFE | 7.48% | 0.30% | 0.795 | 0.1411 |
| 41 | 9 | Ditridecyl adipate | TFE | 20.97% | 0.15% | 0.435 | 0.1113 |
| 42 | 9 | Ditridecyl adipate | TFE | 20.97% | 0.30% | 0.425 | 0.1102 |
| 43 | 6 | Ditridecyl adipate | TFE | 25.76% | 0.30% | 0.42 | 0.1234 |
| 44 | 6 | Ditridecyl adipate | TFE | 25.76% | 0.15% | 0.405 | 0.1223 |
| 45 | 7 | Ditridecyl adipate | TFE | 29.51% | 0.15% | 0.49 | 0.1146 |
| 46 | 7 | Ditridecyl adipate | TFE | 29.51% | 0.30% | 0.4 | 0.1389 |
| 47 | 2 | Octanoic acid | TFE | 48.04% | 0.15% | 0.655 | 0.1256 |
| 48 | 2 | Octanoic acid | TFE | 48.04% | 0.30% | 0.65 | 0.1334 |

[a]Weight percent ditridecyl adipate

EXAMPLE 49

Reaction of TFE with Jayflex-DIDA

A 1-L stirred vertical autoclave was charged with 275 g of Jayflex-DIDA and 20 g (0.14 mol) of t-butyl peroxide. The vessel was closed and pressurized to 3.45 MPa with nitrogen and vented. The vessel was then charged to 410 kPa with TFE and vented 3 times. The vessel was stirred at 500 rpm and heated to 150° C. and TFE was added at a rate to maintain pressure between 723–1600 kPa. A total of 138 g (1.38 mol) TFE was added over a 3.5 h period. After a 12 h hold period at 150° C., the vessel was cooled and the contents were collected. The vessel was rinsed with acetone, the acetone wash was concentrated by rotary evaporation, and the residue was combined with the bulk crude to afford 411.3 g of crude product. The volatile components of this mixture were removed by vacuum distillation (195° C./67 Pa/2 h) to leave 370.5 g residue. Elemental analysis was 59.36% C, 8.40% H, 23.48% F. $^{19}$F NMR overlapping signals from −106 to −138 ppm.

What is claimed is:

1. A composition comprising:

(a) a major portion of a lubricant base, selected from the group consisting of petroleum derived lubricants, synthetic hydrocarbons, polyether oils, carboxylic esters, phosphoric acid esters, silicone containing oils, and halogenated hydrocarbons and halocarbons; and (b) a minor portion of a first lubricant additive which is an organic compound which is grafted with one or more fluorinated olefins and which, when combined with a lubricant base forms a fluorine-containing lubricant, the amount of fluorine in the lubricant composition being 200 parts per million to 10 per cent by weight;

and provided that:

said additive contains at least 5 percent by weight of fluorine; and said organic compound contains at least one functional group which can be adsorbed on a metal surface and wherein said functional group is selected from the group consisting of carboxylic esters, carboxylic acids, carboxylic amides, imides, amines, phosphoric acid derivatives, phosphonic acid derivatives, dithiophosphate esters, ethers, hydroxyls, carbonates, thio derivatives thereof, and heterocyclic groups:

and wherein said fluorine-containing lubricant contains 200 parts per million to 10 percent by weight of fluorine.

2. The composition as recited in claim 1 wherein said lubricant base is derived from petroleum or is a synthetic hydrocarbon.

3. The composition of claim 1 wherein said fluorine in the lubricant contains 500 parts per million to 3 percent by weight of fluorine.

4. The composition as recited in claim 1 wherein said fluorinated olefin is tetrafluoroethylene, chlorotrifluoroethylene, hexafluoropropylene, 3,3,4,4,5,5,6,6,6-nonafluoro-1-hexene, perfluoro(methyl vinyl ether), vinylidene fluoride, trifluoroethylene, or perfluoro(n-propyl vinyl ether).

5. The composition as recited in claim 1 wherein said fluorinated olefin is tetrafluoroethylene.

6. The composition as recited in claim 1 wherein said functional group is carboxylic ester.

7. The composition as recited in claim 1 wherein said composition has about 500 ppm to about 3 percent by weight of fluorine from said first additive.

8. An apparatus, comprising:

(a) a first part which is metal;

(b) a second part which is in apparent contact with said first metal part, and said first part and second part move with respect to one another; and (c) a lubricant which comprises:

(i) a major portion of a lubricant base; and (ii) a minor portion of a first lubricant additive which is an organic compound which is grafted with one or more fluorinated olefins and which, when combined with a lubricant base, forms a lubricant;

and provided that:

said additive contains at least 5 percent by weight of fluorine; and said organic compound contains at least one functional group which can be adsorbed on a metal surface and wherein said functional group is selected from the group consisting of carboxylic esters, carboxylic acids, carboxylic amides, imides, amines, phosphoric acid derivatives, phosphonic acid derivatives, dithiophosphate esters, ethers, hydroxyls, carbonates, thio derivatives thereof, and heterocyclic groups.

9. The apparatus as recited in claim 8 wherein said second part is metal.

10. The apparatus as recited in claim 8 or 9 wherein said metal is one or more ferrous metals.

11. The apparatus as recited in claim 8 wherein said lubricant base is derived from petroleum or is a synthetic hydrocarbon.

12. The composition of claim 1 wherein said fluorine in the lubricant contains 0.10 to 1.0 percent by weight of fluorine.

13. The apparatus as recited in claim 8 wherein said fluorinated olefin is tetrafluoroethylene, chlorotrifluoroethylene, hexafluoropropylene, 3,3,4,4,5,5,6,6,6-nonafluoro-1-hexene, perfluoro(methyl vinyl ether), vinylidene fluoride, trifluoroethylene, or perfluoro(n-propyl vinyl ether).

14. The apparatus as recited in claim 8 wherein said fluorinated olefin is tetrafluoroethylene.

15. The apparatus as recited in claim 8 wherein said functional group is carboxylic ester.

16. The apparatus as recited in claim 8 wherein said lubricant has about 500 ppm to about 3 percent by weight of fluorine from said first additive.

17. The composition as recited in claim 1 wherein said lubricant base is derived from petroleum.

* * * * *